US005555836A

United States Patent [19]

Lord

[11] Patent Number: 5,555,836

[45] Date of Patent: Sep. 17, 1996

[54] FOLDING SPINNAKER POLE SYSTEM

[76] Inventor: Douglas W. Lord, 734 N. Irma Ave., Orlando, Fla. 32803

[21] Appl. No.: 567,308

[22] Filed: Dec. 5, 1995

[51] Int. Cl.[6] ..... B63H 9/10

[52] U.S. Cl. ..... 114/89; 114/102

[58] Field of Search ..... 114/39.1, 89, 90, 114/91, 92, 97, 98, 101, 102, 103, 108, 109

[56] References Cited

U.S. PATENT DOCUMENTS

| | | | |
|---|---|---|---|
| 358,673 | 3/1887 | Johnson | 114/98 |
| 3,185,121 | 5/1965 | Nilsen | 114/102 |
| 4,292,910 | 10/1981 | Hoyt | 114/102 |
| 5,048,442 | 9/1991 | Hackney | 114/102 |
| 5,109,786 | 5/1992 | Hall | 114/89 |
| 5,347,945 | 9/1994 | McAlpine | 114/89 |

*Primary Examiner*—Stephen Avila
*Attorney, Agent, or Firm*—William M. Hobby, III

[57] ABSTRACT

A sailing vessel includes a hull having a mast supported thereon in a vertical direction from the hull and a spinnaker pole support mounted to the hull forward of the mast. A pair of spinnaker poles are movably attached to the spinnaker pole support with each spinnaker pole having fully open and retracted positions and being spring biased towards an open position. Each spinnaker pole can be retracted against the spring bias from an open to a closed position and supported in any position therebetween. A spinnaker sail is attached between the mast and the pair of spinnaker poles so that the spinnaker can be trimmed, jibed or headed up to a beam reach with a pair of spinnaker poles. A pair of cords attached to the spinnaker pole allows for the remote control of the spinnaker poles relative to the spinnaker pole support.

13 Claims, 2 Drawing Sheets

FOLDING SPINNAKER POLE SYSTEM

BACKGROUND OF THE INVENTION

In sailing vessels, it is usual to utilize a spinnaker for reaching and sailing down wind. A spinnaker is a triangular sail that is defined by a head with a balloon-shaped body and a clew and a tack forming the other two corners. To set the sail, a spinnaker pole is utilized, the spinnaker pole being swivably mounted to the mast and extending outwardly therefrom to be fastened to the tack corner of the spinnaker. The clew, having a sheet attached thereto, is normally led aft and the pole having a guy attached thereto, is also led aft so that between the sheet and the guy, the trim of the spinnaker as it relates to the angle of the apparent wind, may be suitably adjusted. Spinnaker poles of this nature have long been known and are exemplified as, for example, in the Johnson U.S. Pat. No. 358,673 of 1887. This patent also points up the problem that exists particularly for the cruising sailor in that it is difficult to jibe a spinnaker. Basically, while the pivoted pole might work in some situations, it has been found that the best system is raising the inner end of the pole up the mast, detaching the pole from one of the corners of the spinnaker and passing the pole down behind the head stay and reattaching it on the other side of the vessel. This is a complicated task which requires strength, knowledge and agility and a fairly large crew if the maneuver is to be completed with smart seamanship.

In U.S. Pat. No. 4,292,910, there is disclosed the patent concept of mounting a spinnaker pole at the forward portion of a sailing vessel on a rigid support means by essentially rotatably securing the pole in a rotatable fashion on the support means and releasably holding the pole so that it can be slid transversely. The control of the pole is through manually moving the pole through a sleeve that serves as the rotatable securing device on the top of the support means together with a pair of lines, one of which is a sheet and the other a guide. In U.S. Pat. No. 4,501,217, an improved control for a spinnaker pole is disclosed where the pole is releasably held in a sleeve on a rotatable support that has pole control lines for laterally sliding the pole relative to the support clew lines for driving the clew out to the ends of the pole, as well as pole direction changing lines.

In contrast to these prior art patents, the present invention provides a pair of spinnaker poles which allows for remotely controlling the spinnaker so that it can be trimmed from a beam reach to a dead down wind, jibed, and headed up to a beam reach on the opposite tack. The spinnaker poles are spring loaded to an open position so that they can be retracted to any degree back to the sides of the hull of the sailing vessel where they can be attached in a closed position. The spinnaker poles and pole support in accordance with the present invention can advantageously be utilized in model sailing craft, such as remote controlled sailboats, so that the spinnaker poles can be remotely controlled to improve the operation of the spinnaker.

SUMMARY OF THE INVENTION

A sailing vessel includes a hull having a mast supported thereon in a vertical direction from the hull and a spinnaker pole support mounted to the hull forward of the mast. A pair of spinnaker poles are movably attached to the spinnaker pole support with each spinnaker pole having fully open and retracted positions and being spring biased towards an open position. Each spinnaker pole can be retracted against the spring bias from an open to a closed position and supported in any position therebetween. A spinnaker sail is attached between the mast and the pair of spinnaker poles so that the spinnaker can be trimmed, jibed or headed up to a beam reach with a pair of spinnaker poles. A pair of cords attached to the spinnaker pole allows for the remote control of the spinnaker poles relative to the spinnaker pole support.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
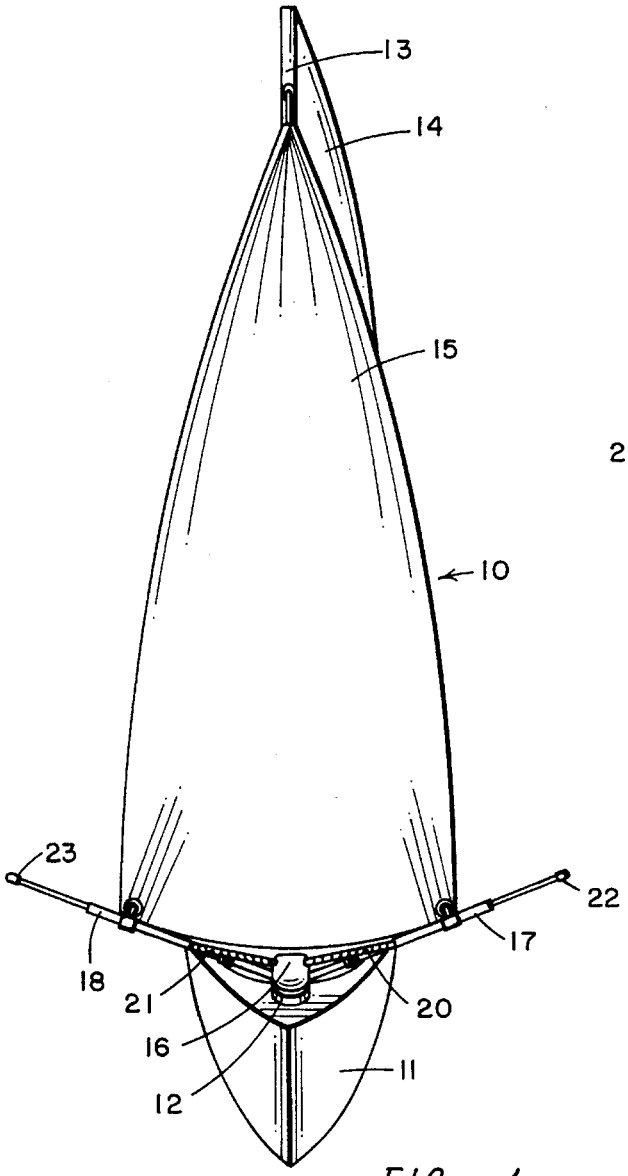
FIG. 1 is a front perspective view of a sailing vessel having a spinnaker mounted on spinnaker poles in accordance with the present invention.

Referring to the drawings and especially to FIG. 1, a sailing vessel 10 has a hull 11 having a bow 12. The sailing vessel 10 has a mast 13 having a sail 14 along with a spinnaker 15. The spinnaker 15 is attached to the mast 13. The hull 11 has a spinnaker pole support 16 rotatably attached to the bow 12 and a pair of a spinnaker poles 17 and 18 extending therefrom. The spinnaker pole support 16 is rotatably mounted to the hull and has a coil spring 20 attached to one side thereof and a coil spring 21 attached to the other side thereof. The coil spring 20 extends from and is attached to the spinnaker pole 17 while the coil spring 21 is attached to the spinnaker pole 18. It should, of course, be clear that other spinnaker pole biasing means are anticipated as being used to bias the spinnaker poles, including having each spinnaker pole made with an inherently biasing portion adjacent the spinnaker pole mount 16. The spinnaker pole 17 has a flexible tip portion 22 while the spinnaker pole 18 has a flexible tip portion 23.

Figure 2:
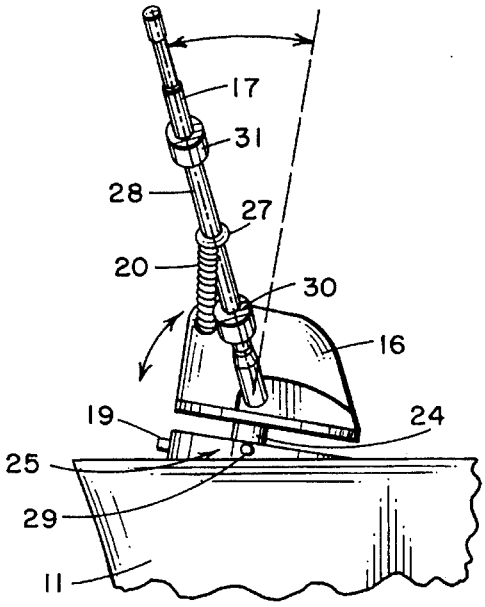
FIG. 2 is a partial elevation of one side of a spinnaker pole and spinnaker pole mount in accordance with the present invention.
Figure 4:
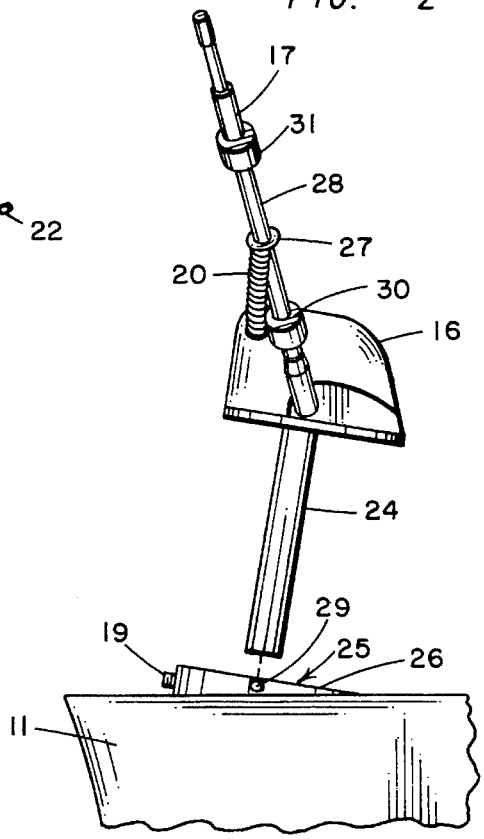
FIG. 4 is an exploded view of the spinnaker pole mount adjacent the sailing vessel hull.
Figure 3:
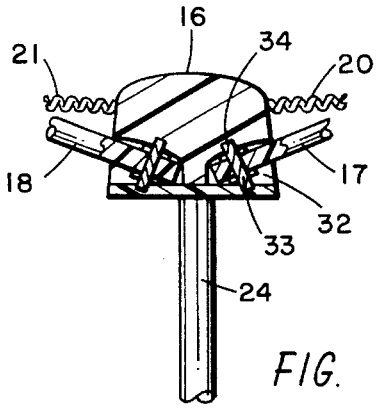
FIG. 3 is a sectional view taken through the spinnaker pole mount of FIGS. 1 and 2.

As seen in FIGS. 2, 3 and 4, the spinnaker pole support has a shaft 24 extending therefrom which fits into a sleeve support 25. The sleeve support 25 is attached to the bow 12 of the hull 11 and allows the spinnaker pole support 16 to rotate or swivel therein. The sleeve and base 25 can be seen having an angular surface 26 which sets the spinnaker pole support 16 at an angle for rotation on an angle. The spring 17 can be seen attached at one end to a sleeve 27 riding around a smooth tubular portion 28 of the spinnaker pole 17 and having an enlarged cylindrical stop member 30 at one end and an enlarged cylindrical stop member 31 at the other end to limit the amount of slide of the spring end 27 on the sliding portion 28. A set screw 19 in the support base 25 allows the shaft 24 to be locked in place. A pin 29 extends through the base 25 and attaches to the sleeve holding the shaft 24.

Figure 5:
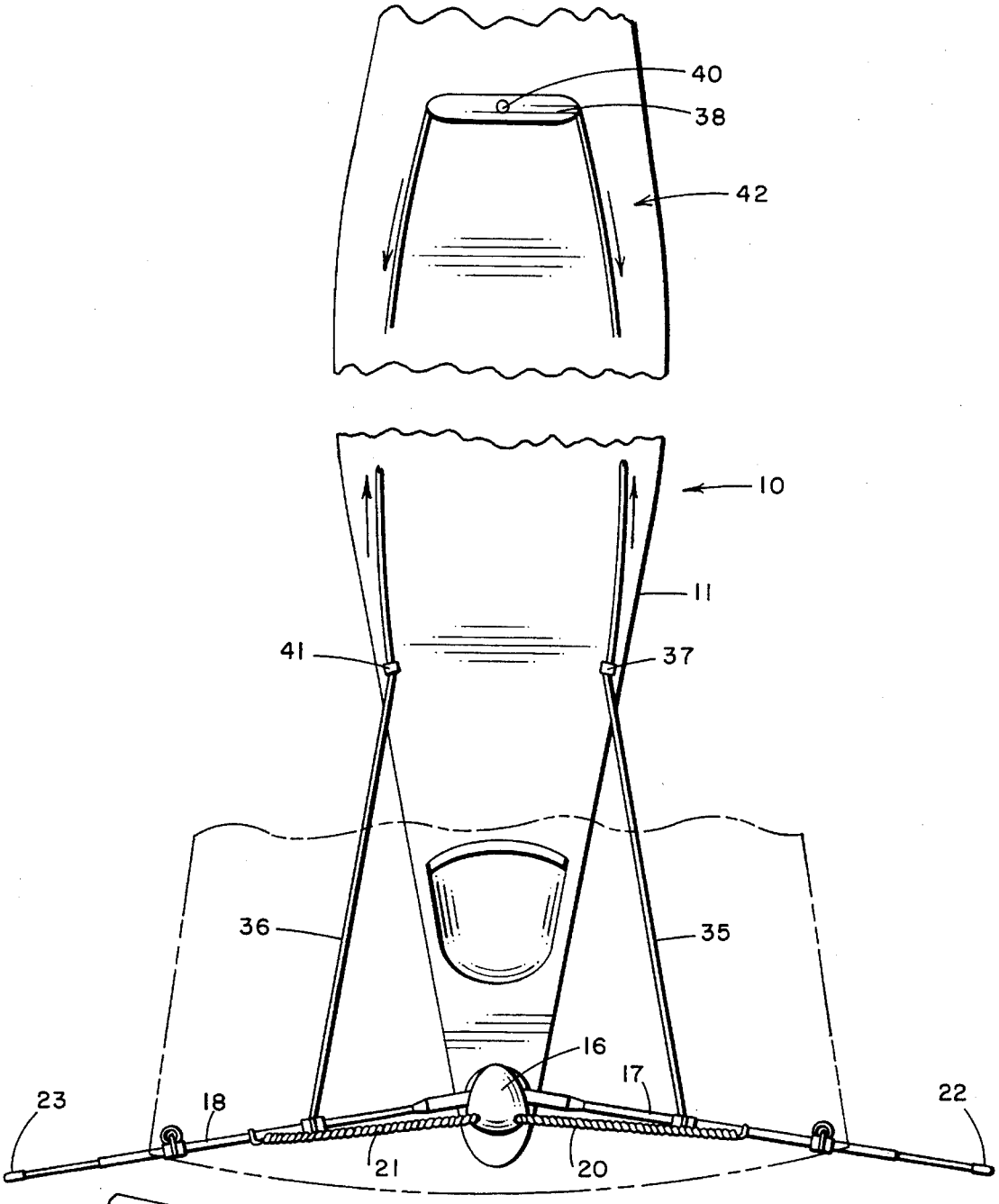
FIG. 5 is a top elevation of a sailing vessel having opened spinnaker poles in accordance with the present invention.

As more clearly indicated in FIG. 3, each spinnaker pole 17 and 18 is connected through an opening 32 in the spinnaker pole support 16 and has a locking member 33 placed therein supported in an annular groove 34 which is placed at an angle to support the spinnaker pole 17 and 18 in an upright angle to the vertically extending rod 24. As seen in FIG. 2, the spinnaker pole 17 is held in a open position, as illustrated in FIG. 1, by the force of the coil spring 17 so that when the spinnaker pole 17 is pulled, as shown by the arrows, it will expand the coil springs 17 to allow the spinnaker pole 17 to be extended backwards at an angle to any desired position from the fully opened position, as shown in FIG. 5, to a fully closed position, as shown in FIG. 6.

Figure 6:
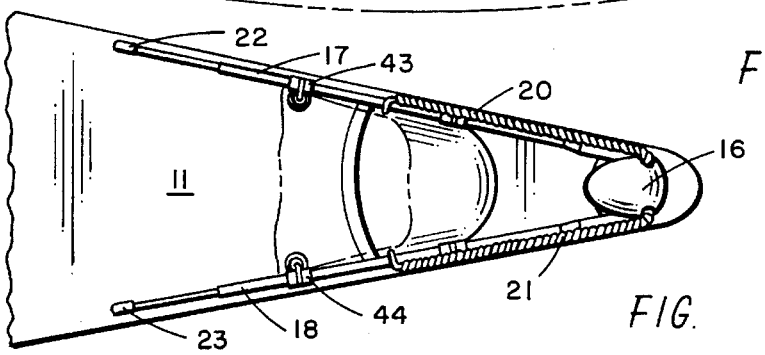
FIG. 6 is a partial top elevation having the spinnaker poles in a retracted position.

As seen in FIG. 6, the spinnaker pole 17 has a flexible line 35 attached thereto while the spinnaker pole 18 has a flexible line or cord 36 attached thereto. The flexible line 35 extends backwards from the pole 17 and is supported in eyelet 37 leading back to a control arm 38 pivoting on a shaft 40. The shaft 40 can be remotely controlled with a servo, or the like, as desired. The flexible cord 36 extends through eyelets 41 and back to the arm 38. Thus, the spinnaker can be folded from a position in the rear of the hull 42. The lines 35 and 36 can be controlled to simultaneously pull the spinnaker poles 17 and 18 against the springs 20 and 21 to any desired point for trimming the spinnaker as desired so that the folding pivoting set of spinnaker poles 17 and 18 have a pivot which allows the spinnaker to be trimmed from a beam reach to dead down wind or jibed or headed up to a beam reach on the opposite tack. The beam pivot point takes most of the load of the spinnaker allowing for very easy control manually or by operation with servos. The spinnaker poles 17 and 18 can be withdrawn to a fully retracted position, as shown in FIG. 6, in which the spinnaker pole 17 is attached to a pole clamp 43 in a retracted position while spinnaker pole 18 is held in a fully retracted position by clamp 44. The control lines 35 and 36 allow for both the positioning of the poles 17 and 18 relatively to the pole mount 16 as well as the rotation of the pole mount 16 on the shaft 24 for greater flexibility in the use of the spinnaker 15 and are additionally mounted at an angle in accordance with the base plate 25 at angle 26 of FIG. 4.

It will be clear that the lines 35 and 36 can be automatically controlled with a control servo or the like mounted below the deck of the hull which can in turn be remotely controlled for controlling a model radio controlled sailboat where giving greater control of the spinnaker will enhance the operation of the model sailboat in a race.

It should also be clear that a sailing vessel has been provided having a hull and a mast along with a spinnaker pole and a spinnaker which includes spinnaker poles attached to the hull which are biased towards a fully open position but can be trimmed to any position desired and can be put in a retracted position and attached to the hull. However, the present invention should not be construed as limited to the forms shown which are to be considered illustrative rather than restrictive.

I claim:

1. A sailing vessel comprising:

a hull having a mast supported thereon in a vertical direction from the hull;

a spinnaker pole support mounted to said hull forward of said mast;

a pair of spinnaker poles attached to said spinnaker pole support, each said spinnaker pole being positionable between a fully retracted and a fully open position and having biasing means biasing each said spinnaker pole towards a fully open position so that each said spinnaker pole can be retracted against a bias between an open and a retracted position; and a spinnaker sail attached between said mast and said pair of spinnaker poles, whereby a spinnaker can be trimmed, jibed or headed up to a beam reach with a pair of spinnaker poles.

2. A sailing vessel in accordance with claim 1 in which each said spinnaker pole support is rotatably supported to said hull.

3. A sailing vessel in accordance with claim 2 in which each said spinnaker pole biasing means includes a spring.

4. A sailing vessel in accordance with claim 2 in which said hull has spinnaker pole attaching members for holding each said spinnaker pole in a retracted position.

5. A sailing vessel in accordance with claim 4 in which each said spinnaker pole has an elongated flexible line attached thereto for remotely retracting each said spinnaker pole to a retracted position.

6. A sailing vessel in accordance with claim 1 in which each said elongated flexible line is a flexible cord.

7. A sailing vessel in accordance with claim 5 in which each said elongated flexible line extends along said hull and is slidable supported in support eyes attached to said hull.

8. A sailing vessel in accordance with claim 3 in which each said spring is attached between said spinnaker pole support and one said spinnaker pole.

9. A sailing vessel in accordance with claim 8 in which each said spring has two ends and has one end slidably attached to one said spinnaker pole.

10. A sailing vessel in accordance with claim 9 in which each said spring is slidably attached to one said spinnaker pole with a sleeve slidably mounted between a pair of stops on each said spinnaker pole.

11. A sailing vessel in accordance with claim 2 in which said spinnaker pole support is rotatably supported at an angle to said hull.

12. A sailing vessel in accordance with claim 11 in which said spinnaker pole support includes a shaft slidably mounted in a hull mounted sleeve support attached to said hull.

13. A sailing vessel in accordance with claim 1 in which said spinnaker is slidably attached to each said spinnaker pole.

* * * * *